US006966441B2

(12) United States Patent
Barham et al.

(10) Patent No.: US 6,966,441 B2
(45) Date of Patent: Nov. 22, 2005

(54) SANITARY TOOTHBRUSH CLEANING FLASK

(76) Inventors: William L. Barham, 151 Greenbridge Dr., Mt. Airy, NC (US) 27030; William B. Barham, 493 Somerwalk Cir., Chapel Hill, NC (US) 27517

( * ) Notice: Subject to any disclaimer, the term of this patent is extended or adjusted under 35 U.S.C. 154(b) by 157 days.

(21) Appl. No.: 10/420,281

(22) Filed: Apr. 22, 2003

(65) Prior Publication Data

US 2004/0211683 A1 Oct. 28, 2004

(51) Int. Cl.[7] ..... B65D 81/22
(52) U.S. Cl. ..... 206/362.2; 206/209.1
(58) Field of Search ..... 206/63.5, 209, 206/209.1, 361, 362.2, 362.3, 15.2, 15.3; 132/308–310; 433/229; 422/300, 301

(56) References Cited

U.S. PATENT DOCUMENTS

| | | | | |
|---|---|---|---|---|
| 1,584,261 A | | 5/1926 | Vuolo | |
| 2,630,912 A | * | 3/1953 | Warner et al. | 206/15.2 |
| 3,574,879 A | * | 4/1971 | Werding | 206/362.2 |
| 4,585,119 A | * | 4/1986 | Boyington | 206/209.1 |
| 4,738,355 A | * | 4/1988 | Jobe | 206/5.1 |
| 5,022,559 A | * | 6/1991 | Condon | 206/15.3 |
| 5,566,823 A | | 10/1996 | Summers | |
| 5,690,214 A | | 11/1997 | Gaines et al. | |
| 5,772,015 A | * | 6/1998 | Musiel et al. | 206/209 |
| D405,613 S | | 2/1999 | Krainsky | |
| 6,135,279 A | | 10/2000 | Dryer | |
| 6,213,777 B1 | | 4/2001 | Seitzinger | |
| 6,360,884 B1 | | 3/2002 | Smith et al. | |
| 6,702,113 B2 | * | 3/2004 | Marino | 206/209.1 |
| 6,728,990 B1 | * | 5/2004 | Jones | 206/361 |
| 2004/0129580 A1 | * | 7/2004 | Cochran et al. | 206/15.2 |

* cited by examiner

*Primary Examiner*—Luan K. Bui
(74) *Attorney, Agent, or Firm*—Robert W. Pitts

(57) ABSTRACT

Flasks 10, 110, 210 and 310 serve as a storage container for toothbrushes 2, 2A and serve are reservoirs for a treating solution, such as a cleaner, which can be used to clean, deodorize, sanitize, decontaminate or otherwise treat the toothbrush between brushings. Flask 10 has an upper section 14 separated from a lower section 22 by an intermediate section 18, which contains a constricted throat 20. A toothbrush 2 in an inverted position would be supported by an inwardly tapered surface 16 above the constricted throat 20. Toothbrush bristles 6 would be located in the enlarged lower section 22, which serves as a reservoir for the treating solution. The constricted throat 22 can be sealed so that overpressure in the lower section can enhance the action of the treating solution. A covered flask 110 can also be used to store or merchandise the toothbrush.

11 Claims, 4 Drawing Sheets

SANITARY TOOTHBRUSH CLEANING FLASK

BACKGROUND OF THE INVENTION

1. Field of the Invention

This invention is related to cleaning and storing toothbrushes, and to a container in which a toothbrush can be packaged for sale and which can subsequently be used to store or treat the toothbrush by cleaning, decontaminating, sanitizing, deodorizing or some combination of these and other treatments.

2. Description of the Prior Art

A number of devices have been suggested for use in storing and cleaning a toothbrush between brushings. Examples of these devices can be found in wing U.S. Pat. Nos. 5,566,823; 5,690,214; 6,135,279; 6,213,777; and 6,260,884. These devices are representative examples of toothbrush holders or storage devices in which one or more toothbrushes are placed in separate receptacles, which may contain a liquid treating agent, such as a cleaner, a dentifrice or an disinfectant or other material. The toothbrushes are raised and lowered into the liquid treating agent. These devices are, however, relatively bulky and comprise separate utensils. They also do not appear suited for shipping a toothbrush or for use as part of the display packaging of the toothbrush in addition to providing a means for cleaning the toothbrush. The instant invention, however, provides a compact flask that has multiple uses and can also be used to create an environment in which a pressure in access of atmospheric pressure can be generated and maintained to enhance the treating or cleaning process.

SUMMARY OF THE INVENTION

According to this invention, a flask for cleaning and storing a toothbrush has an upper section, open to permit insertion and extraction of a toothbrush and a lower section including a base configured to hold the flask in an upright position. The lower section forms a reservoir for holding a fluid for cleaning or otherwise treating the toothbrush, specifically the toothbrush bristles. An intermediate section forms a throat or constriction between the upper and the lower sections. The upper section is tapered toward the intermediate section to form an upwardly facing interior surface on which the toothbrush can be positioned with bristles on the toothbrush extending into the lower section. The constriction or throat limits escape of fluid, in either the liquid or vapor form, from the lower section when the toothbrush is positioned in the flask.

The flask can be part of an assembly including the toothbrush and the flask functions as a storage container including a removable lid, which can either be pressure tight or simply provide a mechanical closure. This storage container encloses the toothbrush and includes an upper section separated from a lower section by a constricted throat. The upper section is open, and the toothbrush can be inserted and removed through this open end. The lower section forms a reservoir into which a fluid can be introduced, the constricted throat being large enough to permit insertion of a toothbrush head and bristles into the lower section, but smaller than a handle on the toothbrush so that a fluid can be introduced into the storage container to clean the toothbrush bristles. This storage container can be used for packaging, shipment, storage and cleaning the toothbrush. Dual use packaging can reduce the user's cost as well as providing an efficient means for distributing the flask and can permit tailoring the flask for use with a specific toothbrush style.

The flask can be used in a method of treating a toothbrush comprising the following steps. A treating solution, such as a cleaner or mouthwash, is dispensed into a reservoir formed on one side of the constricted throat of a flask. The toothbrush is then inserted into the flask with bristles on the toothbrush being inserted through the constricted throat into the reservoir. Insertion of the toothbrush further constricts the constricted throat of the flask to limit escape of fluid from the flask. The toothbrush can then be stored in the flask with the bristles exposed to the treating solution while the toothbrush is stored, until the owner uses the toothbrush for his next brushing.

DETAILED DESCRIPTION OF THE PREFERRED EMBODIMENTS

Figure 1:
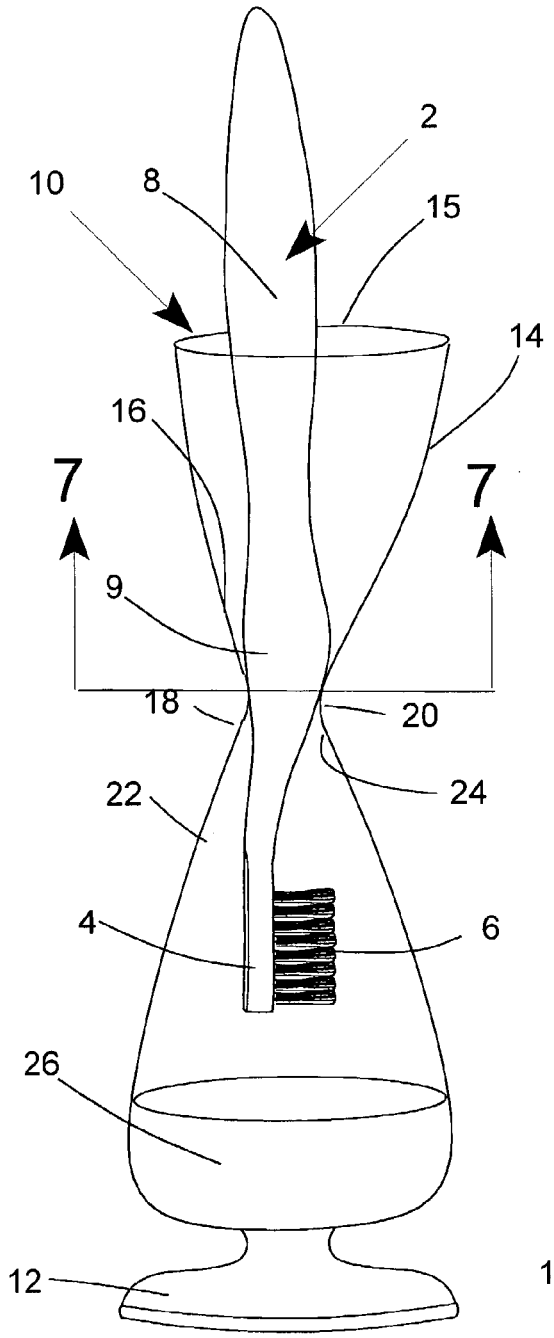
FIG. 1 is a view of a toothbrush positioned in a flask containing a cleaning solution.
Figure 2:
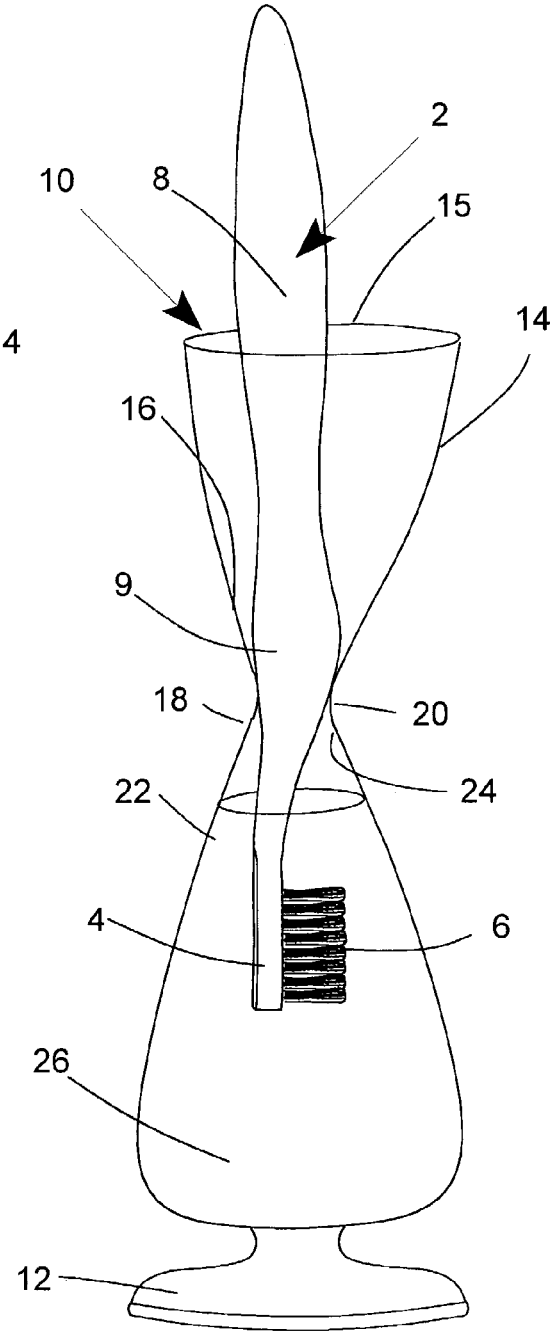
FIG. 2 is a view similar to FIG. 1, but showing the toothbrush bristles immersed in the liquid cleaning solution.
Figure 3:
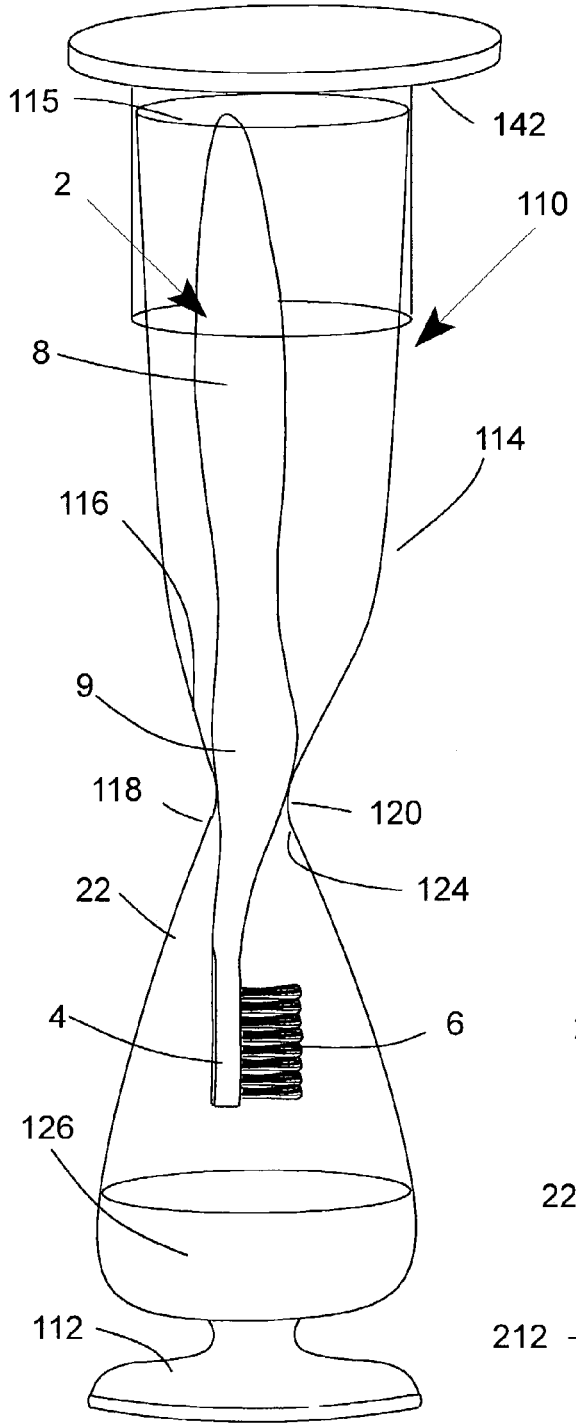
FIG. 3 is a view of an alternate embodiment of this invention in which the cleaning flask can be used to package a toothbrush.
Figure 4:
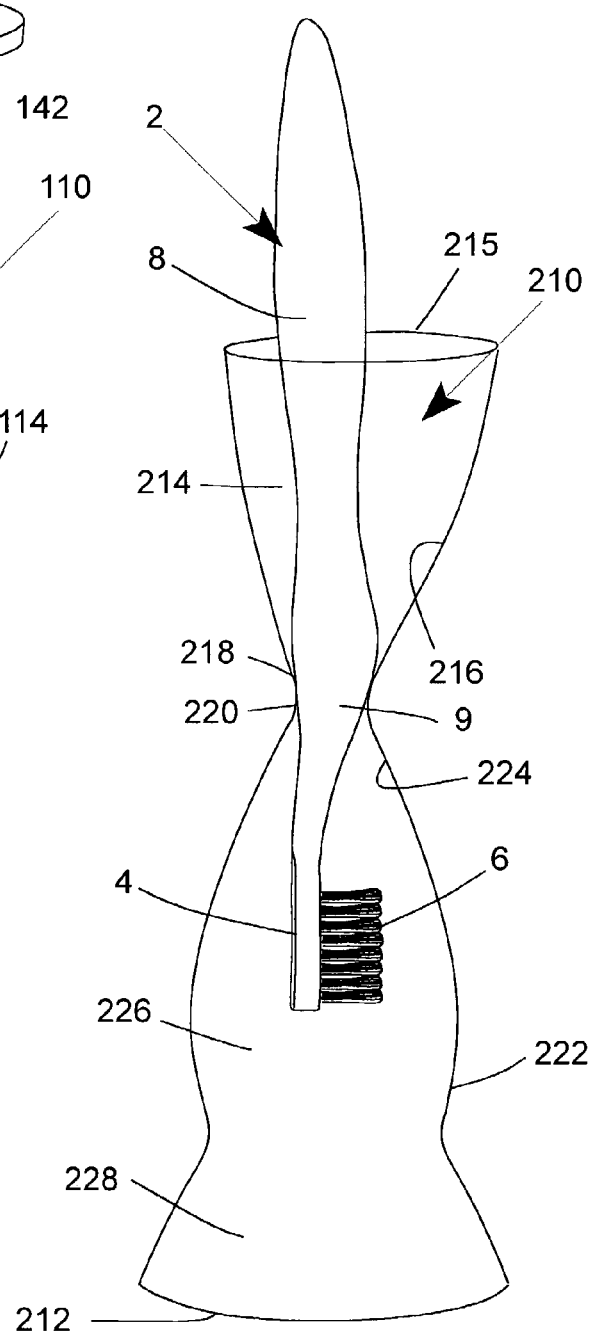
FIG. 4 is a view of an alternate embodiment of this invention in which the flask includes a flared base to provide greater stability and a larger reservoir for the cleaning solution.
Figure 6:
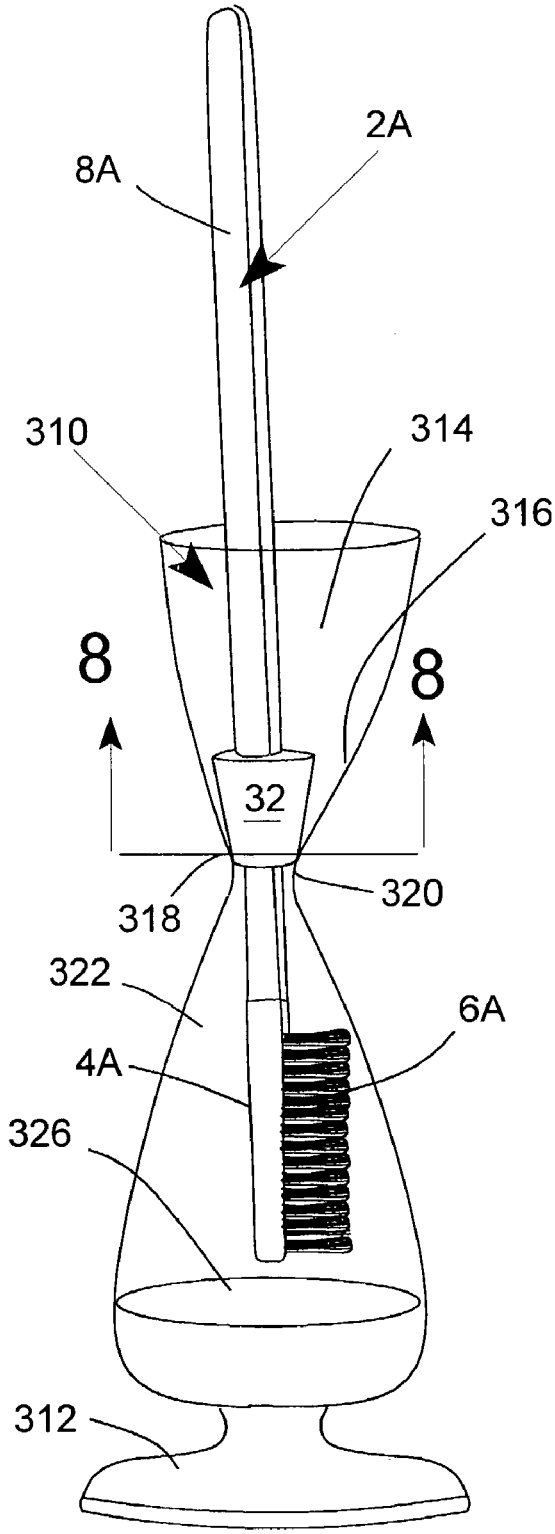
FIG. 6 is a view of a flask suitable for use with the toothbrush of FIG. 5 in which a flexible sealing member has been added to the toothbrush handle.

The flask 10 shown in FIGS. 1, 2 and 6 and the alternate flasks 110, 210 shown in FIGS. 3 and 4 respectively can be used to clean, sanitize, deodorize, decontaminate or otherwise treat a toothbrush 2, 2A. Flash 10 also serves as a storage container until used for the next brushing. This entire time can be used to treat or clean the toothbrush and especially the toothbrush bristles. These embodiments of both the flask and the toothbrush are merely representative and are intended to demonstrate the basic features of this invention. Other embodiments, including embodiments with additional features, can also employ the invention described herein.

FIG. 1 depicts the simplest of the versions of this invention discussed herein. Flask 10 comprises a thin walled, one-piece member having an upper section 14, an intermediate section 18 and a lower section 22. In the preferred embodiment, the flask 10 will be blow molded and will be transparent so that the cleaning, sanitizing or treating action will be visible. A constricted throat 20, having the smallest diameter and cross-sectional area in the flask is part of the intermediate section 18. A toothbrush 2 having a head 4 with bristles 6 and a handle 8 can be inserted into the flask 10 through an open upper end 15. This funnel shaped opening will also facilitate filling the flask with a treating solution, such as mouthwash as well as changing the solution. Typical solutions would be changed every three or four days. As shown in FIG. 1, the head 4 and bristles 6 are inserted first, so that the toothbrush 10 can be stored in an inverted position. The constricted throat 20 has a smaller cross sectional area and smaller lateral dimensions than a section of the toothbrush handle 8. A peripheral surface 9 on the toothbrush handle 8 thus will rest on an upwardly inclined interior surface 16 extending upwardly from the constricted throat 20 into the upper section 14. In some embodiments of this invention, this constricted throat 20 might have a cross sectional area greater than the largest cross sectional area of the handle 8, but would have at least one lateral dimension that would be small enough to obstruct toothbrush handles of normal size. In other embodiments the constricted throat 20 or a closely adjacent portion of the intermediate section 18 would have the same shape as a peripheral surface 9 on the toothbrush handle, so that the handle 8 would fit tightly in the flask. The flask 10 can then be fabricated from a flexible material to facilitate sealing action when the toothbrush is pushed into engagement with the interior surface of the flask. By using a flexible material for the flask, a suitable seal can be established even if the exterior shape of the toothbrush handle does not precisely conform to the interior shape of the flask constriction. An acrylic, such as ethylene vinyl acetate could be used to fabricate the flask. In this latter case, the constricted throat 20 will function to limit the escape of fluid from the lower section 26 when the toothbrush handle 8 extends through the constricted throat. When the handle 8 fits tightly in the constricted throat 20, both the escape of both liquid and gases or vapors will be prevented or restricted. Even when a tight fit is not established, the escape of liquids will be restricted or retarded, and will limit spillage if the flask 10 is overturned. Structures which will enhance the sealing effect in the constricted throat will be subsequently discussed in greater detail.

The lower flask section 22 tapers outwardly from the constricted throat 20. In the preferred embodiment, this lower section 22 has a larger volume than the upper section 14 so that a portion of the lower section 22 can serve as a reservoir 26 for a cleaning or treating solution. In the embodiment of FIG. 1, the lower section 26 has a base 12 so that the flask 10 can stand in an upright position. In the preferred embodiment the base 12 projects from the bottom of the flask. In other embodiments, the flask can have a flat base which will support the flask. Since the lower section 22 is larger than the upper section 14, and the weight of a fluid cleaning or treating solution will result in a relatively low center of gravity, which will tend to reduce the chances that the flask 10 will be tipped over when in use.

When the toothbrush 2 is mounted in flask 10, the toothbrush bristles 6 will extend into the lower section 22. FIG. 1 shows an example in which the bristles 6 will be positioned above the top level of the treating or cleaning solution in the reservoir 26 provided by the lower section 22. FIG. 2 shows an example in which the bristles 6 will be completely immersed in the treating or cleaning solution. Depending upon the nature of the treating solution, it may be desirable to expose the bristles 6 directly to the treating solution or only to expose the bristles 6 to vapors emanating from the treating solution, because prolonged exposure may damage the bristles 6 or tend to loosen the bristles 6 from the head 4 or tend to soften the bristles. In this later case, it may be desirable to limit the escape of these vapors from the flask. Again, sealing in the intermediate section 18 or in the constricted throat 20 will be subsequently discussed in greater detail.

The embodiment shown in FIGS. 1 and 2 is primarily intended as a vessel in which a toothbrush 2 can be stored when not in use, and in which the bristles 6 can be effectively cleaned or otherwise treated by prolonged exposure to the treating fluid or solution, in either a liquid for vapor state. FIG. 3 shows another embodiment that can also be used in this manner. The flask 110 shown in FIG. 3 can also serve as a package or storage container in which the toothbrush 2 can be merchandised, shipped or protected while traveling. Flask 110 also has an enlarged upper section 114, an even larger lower section 122, a portion of which serves as a reservoir 126, and a smaller intermediate section 118, which includes constricted throat 120. Flask 110 has a flat base 112 and upper and lower tapered sections 116 and 124 serve as a transition between the upper and lower sections 114 and 122 respectively and the intermediate section 118. Flask 110 also includes a cap or cover 142 that fits over the open end 115 at the top of the flask 110. This cap 142 is primarily for use when the toothbrush 2 is stored or shipped and, although useful, would not necessarily be needed during cleaning or treatment. When used for merchandising, the flask 110 would be fabricated from a transparent material to display the toothbrush.

FIG. 4 shows a third flask 210 that is in most respects similar to flasks 10 and 110. Flask 210 has an upper section 214 with an upwardly facing open end 215 through which the toothbrush 2 is inserted and removed from the flask 210. A lower section 222 is located on the opposite end of intermediate section 218 and constricted throat 220. Tapered surfaces 216 and 224 form transitions between the upper section 214 and lower section 222 respectively and the constricted throat 220. The lower section 222 also includes an outwardly flared section 228 at the lower end of the flask 210. This outwardly flared section 228 serves at least three purposes. First, it increases the surface area of base 212, increasing the stability of the flask 210. Second outwardly flared section 228 increases the volume of the reservoir 226 so that a larger quantity of treating fluid can be accommodated. The increased volume afforded by the outwardly flared section 228 will also provide extra space if the flask 210 is overturned so that more fluid will be remain in the flask reducing the extent of any spills.

Figure 5:
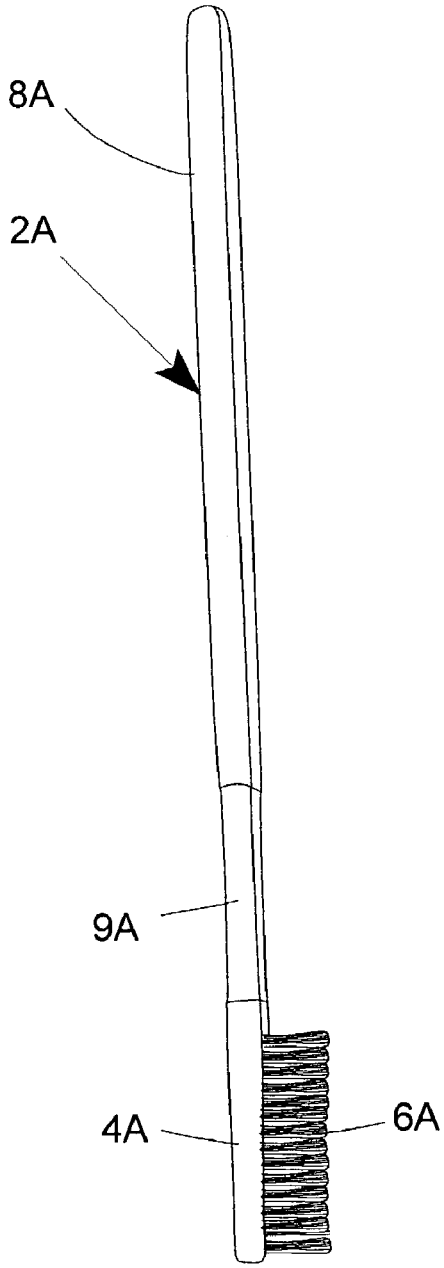
FIG. 5 is a view of different style toothbrush.

The flasks 10, 110 and 210 are shown in use with a toothbrush 2 having an ergonomic design and with a circular cross section that could fit within a circular constriction. A toothbrush having this configuration is commercially available from Oral B. This particular toothbrush has a handle 8 with a relatively large section adjacent the smaller head 4. This relatively large section need not have the largest cross section in the handle 8, but it should be larger than the head 4, so the head can be inserted through the constricted throat 20, but the handle will rest on and be supported by the tapered and converging surface 16, 116 or 216 which forms the transition from the upper flash section 114 to the constricted throat 20. Other more commonly available toothbrushes, such as toothbrush 2A shown in FIG. 5, can be inserted in similar flasks. Toothbrush 2A has a handle 8A with a generally rectangular cross section and the head 4A, on which bristles 6A are mounted, can also have a generally rectangular cross section. A recessed neck 9A, extending between the handle 8A and the head 4A, also has a rectangular cross section, but has a smaller cross sectional area than the handle 4A. This toothbrush 2A can be used in a flask 310 having an upper section 314, an intermediate section 318, a lower section 322 including a reservoir 326. The constriction, or throat 320 has a generally circular shape and a flexible or pliable fitting or stopper 32 can be mounted on the toothbrush 2A, here near the juncture of the handle 4A and the recessed neck 9A. The fitting or stopper 32 has a central bore 36 to accommodate the toothbrush 2A and an exterior surface 34, which if tapered, will abut the upwardly facing interior surface 316 above the constricted throat 320. This alternate version would be especially suitable for use in a hospital or other health care institution, an especially hostile bacterial environment. A flask and stopper can be provided for use with the patient's toothbrush. It would also be suitable for as a travel toothbrush.

Figure 7:
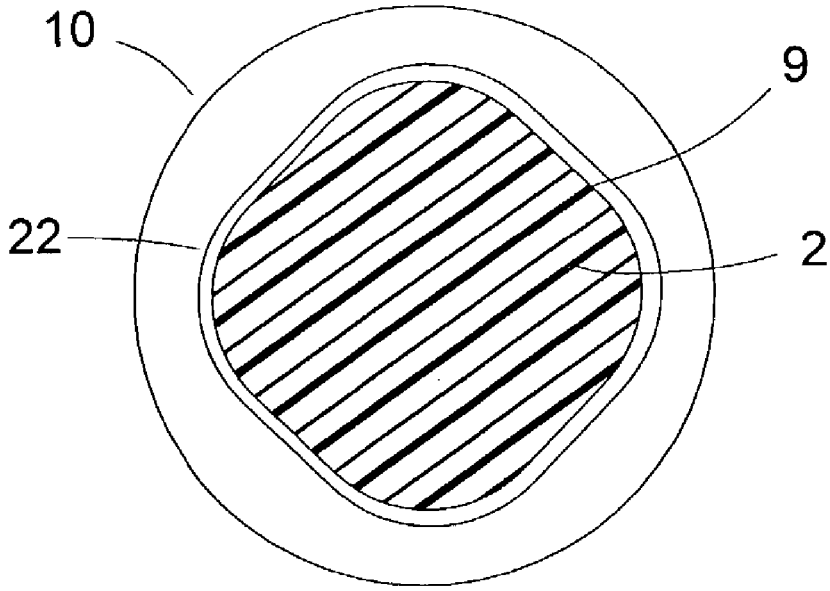
FIG. 7 is a sectional view taken along section 7—7 in FIG. 1 showing the manner in which the toothbrush handle fits within a noncircular flask constricted throat.
Figure 8:
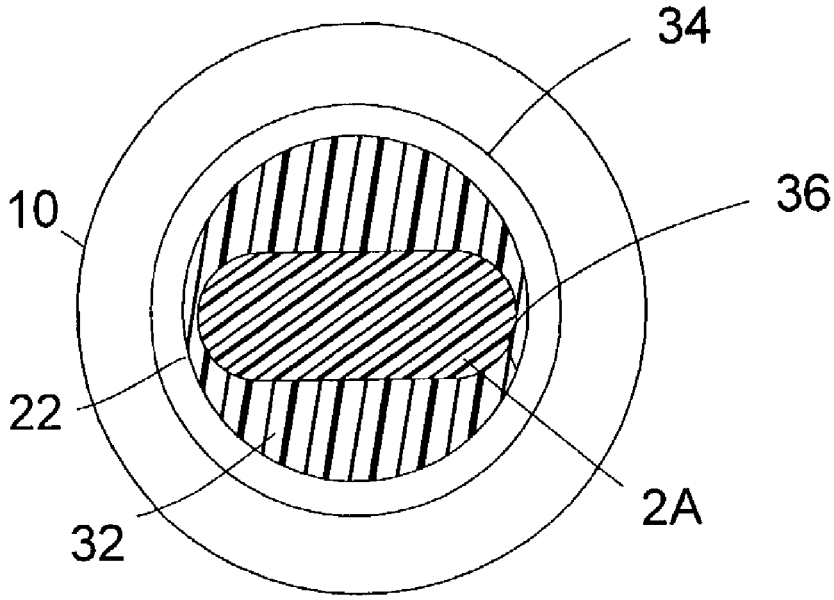
FIG. 8 is a sectional view taken along section 8—8 in FIG. 6 showing the use of a sealing member between the toothbrush handle and the constricted area of the flask.

The fitting or plug 32 should be flexible or pliable so that it can fit over the handle 8A and so that it can contiguously engage the interior surface of the flask 310 to form a seal or a tight restriction. FIG. 8 is a cross sectional view showing the engagement of the fitting or stopper 32 with a generally cylindrical flask 310. FIG. 7 shows the engagement of a noncircular peripheral surface 9 on toothbrush 2 with the interior of a noncircular interior surface 22 on flask 10. The flask 10 can have a generally circular cross section in at least part of the upper section 14 and the lower section 22, but the intermediate section 18 and the throat 22 would have a noncircular cross section for intimate engagement between the toothbrush peripheral surface 9 and an interior surface of the flask. The flask would then not only converge toward the constriction or throat 20, but the shape would change along the longitudinal axis of the flask 10. To use flask 10 with the toothbrush 2A shown in FIG. 5, it would then be necessary to include a fitting or stopper having an external shape substantially same as its intended contact area on the flask, either along the converging tapered surface 16 or the constriction or throat 22.

Although the toothbrush head 4 or 4A must be inserted through the constriction or throat 22, 122, 222 or 322, this narrowest flask cross section need not be larger than the combination of the head 4 and bristles 6, or head 4A and bristles 6A. Toothbrush bristles by their nature are flexible and will be deflected when inserted through the flask throat and into the lower sections of the flasks. Although it will be relatively easy to insert bristles through a narrower throat, the presence of larger bristles can have an advantageous effect if pressure, greater than atmospheric pressure, is developed in the lower flask sections 22, 122, 222, or 322.

One advantage of a flask in which a tight restriction or seal can be established around the periphery of a portion of a toothbrush above the bristles is that a pressure in excess of atmospheric can be generated and at least to some extent sustained within the lower flask sections. This overpressure can be generated in a number of ways. The treating solution can include agents that generate a gas, such as carbon dioxide, which can be released by chemical action or by agitating the treating solution. Effervescing denture cleaners could be one solution that could be employed. The shape of the flasks 10, 110, 210 and 310 are especially suited for agitating the treating solution contained within the reservoirs 26, 126, 226 and 326. Fluid in these reservoirs can be agitated by swirling the fluid in the flask. The narrow restriction provided by throat 20, 120, 220, or 320 will help prevent spillage and with the toothbrush extending through the constriction or throat, there will be even less chance for spillage. When a seal is formed in or near the throat, no spillage will occur, and this seal or interference fit will allow the pressure within the now closed lower sections 22, 122, 222 or 322 to rise above atmospheric pressure. This overpressure will also enhance the cleaning or treating action of the active ingredients in the treating or cleaning solution because there will be a better chance of penetrating tight spaces surrounding the bristles 6 or 6A, where contaminants will tend to collect, at least with time. Pressurizing a disinfecting solution should diffuse more active agents in the bristles which should then be more effectively transferred to the tooth surface during brushing. Additional active agents should then be helpful in reducing the biofilm formed teeth, which should in turn be helpful in reducing the pathogens or bacteria which inhabit this biofilm. Futhermore active agents "stored" in the toothbrush bristles in this manner should help in reducing the bioflim. Complete or partial elimination of the biofilm will result in complete or partial elimination of bacteria and improve dental hygiene. The bristles 6 will also engage the downwardly facing surfaces 24 should the pressure become great enough to dislodge the toothbrush 2 from its sealed position, so that the toothbrush will not be ejected by a piston effect.

Easily vaporized anti-bacterial agents include aromatics can also be used in this flask and the seal can retain the active vapors in surrounding relationship to the toothbrush bristles. Suitable aromatics can include alcohols, menthol and eucalyptus oil.

In addition to cleaning solutions that would effervesce or would generate gas bubbles, other fluids can be used. Hydrogen peroxide, chlorine dioxide and alcohol can be used. When alcohol is used the bristles 6 can be suspended above the level of fluid in the reservoir 26, as shown in FIG. 1. Alcohol vapors would still act on the bristles, but the bristles would not be immersed in the alcohol, where they might be softened by prolonged exposure to the alcohol. When alcohol is used, the alcohol vapors, being heavier than air, will not rapidly diffuse through the top of the flask 10, and it would not be necessary to maintain a seal between the toothbrush handle 8 and the interior surface of the flask 10. In other situations, the bristles 6 can be drenched by the cleaning solution by swirling the flask 10, and if the bristles are suspended above the fluid in the reservoir, the bristles will remain saturated on the surface.

Although cleaning would be one treatment that could be facilitated by use of this flask, other treatments, such as decontamination or deodorizing could also be accomplished. The apparatus and method of this invention are therefore merely represented by the various embodiments shown and discussed herein. The invention is therefore defined by the following claims and is not limited to the specific embodiments disclosed herein.

We claim:

1. Apparatus for cleaning and storing a toothbrush, the apparatus comprising a flask having an upper section, open to permit insertion and extraction of a toothbrush, a lower section including a base configured to hold the flask in an upright position, the lower section forming a reservoir for holding a fluid for cleaning the toothbrush, and an intermediate section forming a constriction between the upper section and the lower section, the upper section being tapered toward the intermediate section to form an upwardly facing interior surface, the constriction being deformable upon insertion of a handle of the toothbrush therethrough to form a pressure seal to limit escape of fluid from the lower section when the toothbrush is positioned in the flask.

2. The apparatus of claim 1 wherein the intermediate section includes a continuous surface along which a seal can be established to prevent escape of the fluid in a vapor form.

3. The apparatus of claim 1 wherein the constriction in the intermediate section has a noncircular cross section to continuously engage a peripheral surface extending completely around a handle on the toothbrush to limit escape of fluid from the lower section when the toothbrush is positioned in the flask.

4. The apparatus of claim 3 wherein the upper section has a circular opening through which the toothbrush can be inserted and extracted.

5. The apparatus of claim 1 wherein the flask comprises means for packaging, shipping and storing individual toothbrushes.

6. The apparatus of claim 1 wherein the flask includes a removable cover attachable to close an opening in the upper section of the flask to enclose the toothbrush in the flask.

7. The apparatus of claim 1 wherein the flask is formed of a flexible material conformable to a toothbrush inserted into the flask.

8. The apparatus of claim 1 wherein the flask comprises a blow molded member.

9. The apparatus of claim 1 wherein the lower section is tapered toward the intermediate section to form a downwardly facing surface comprising means interfering with the bristles on the toothbrush to retard extraction of the toothbrush from the flask in the presence of a pressure within the lower section of the flask exceeding atmospheric pressure.

10. An assembly comprising a toothbrush and a storage container including a removable lid, the storage container completely enclosing the toothbrush when the lid is placed on the storage container and comprising an upper section separated from a lower section by a constricted throat, the upper section having an open end through which the toothbrush can be inserted and removed, and the lower section forming a reservoir into which a fluid can be introduced, the constricted throat being large enough to permit insertion of a toothbrush head and bristles into the lower section, but smaller than a handle on the toothbrush so that a fluid can be introduced into the storage container to clean the toothbrush bristles and the same storage container can be used for packaging, shipment, storage and cleaning the toothbrush.

11. The assembly of claim 10 wherein the constricted throat is deformable to conform to a section of the toothbrush to seal the reservoir when the toothbrush is inserted into the constricted throat.

* * * * *